US007398635B2

(12) United States Patent
Fairweather et al.

(10) Patent No.: US 7,398,635 B2
(45) Date of Patent: Jul. 15, 2008

(54) METHOD AND DEVICE FOR ALIGNING A RECEIVING ENVELOPE IN A MAIL INSERTER

(75) Inventors: James A. Fairweather, Milford, CT (US); George J. Doutney, Sandy Hook, CT (US); Robert J. Allen, Shelton, CT (US); Thomas M. Lyga, Southbury, CT (US); Daniel P. Goslicki, Jr., Wethersfield, CT (US)

(73) Assignee: Pitney Bowes Inc., Stamford, CT (US)

( * ) Notice: Subject to any disclaimer, the term of this patent is extended or adjusted under 35 U.S.C. 154(b) by 90 days.

(21) Appl. No.: 11/329,468

(22) Filed: Jan. 11, 2006

(65) Prior Publication Data

US 2007/0157578 A1 Jul. 12, 2007

(51) Int. Cl.
*B65B 43/26* (2006.01)

(52) U.S. Cl. ..... 53/569; 53/284.3

(58) Field of Classification Search ..... 53/569, 53/206, 284.3
See application file for complete search history.

(56) References Cited

U.S. PATENT DOCUMENTS

| | | | | |
|---|---|---|---|---|
| 2,736,999 | A * | 3/1956 | Rouan et al. | 53/55 |
| 4,020,615 | A * | 5/1977 | Irvine et al. | 53/473 |
| 5,247,780 | A * | 9/1993 | Kulpa et al. | 53/381.5 |
| 5,284,004 | A * | 2/1994 | Metzler | 53/569 |
| 5,388,388 | A * | 2/1995 | Belec et al. | 53/460 |
| 5,992,132 | A * | 11/1999 | Auerbach | 53/569 |
| 6,289,658 | B1 * | 9/2001 | Sting et al. | 53/569 |
| 6,536,184 | B1 * | 3/2003 | Sting et al. | 53/284.3 |
| 6,789,377 | B2 * | 9/2004 | Sting et al. | 53/569 |

* cited by examiner

*Primary Examiner*—Sameh H. Tawfik
(74) *Attorney, Agent, or Firm*—Brian A. Collins; Steven J. Shapiro; Angelo N. Chaclas

(57) ABSTRACT

In a mail inserter having an envelope movement mechanism to move an envelope into an insertion station and a feeder to move a pack of insert material into an insertion position so that the insert material can be inserted into the envelope, a linear array of optical sensing elements is used to determine the position of one edge of the insert material and another linear array of optical sensing elements is used to determine the position of one edge of the receiving envelope in order to make sure that there is sufficient end clearance between the insert material and the receiving envelope. A stepper motor is used to adjust the envelope position, if the end clearance is outside a predetermined range.

7 Claims, 3 Drawing Sheets

METHOD AND DEVICE FOR ALIGNING A RECEIVING ENVELOPE IN A MAIL INSERTER

TECHNICAL FIELD

The present invention relates generally to a mail inserter and, more particularly, to the adjustment of a receiving envelope in the insertion station relative to the insert material.

BACKGROUND OF THE INVENTION

A typical mailing machine has a mail inserter section where a pack of insert material is inserted into an envelope. The mailing machine may have an accumulation section where a plurality of insert documents are fed and accumulated into a stack. The accumulated documents may be folded. The mailing machine may also have a printing section for printing the insert documents or the envelopes. In order to ensure that a pack of insert material is properly inserted into a receiving envelope, the width of the envelope must be greater than the width of the pack by a certain amount. The minimum difference in width allowed on each side of the envelope is referred to as the required "end clearance". The required end clearance depends on the thickness of the pack to be inserted into the receiving envelope. It may also depend on other factors such as the expected material tolerances, the accumulation system and the lateral offset when the accumulated documents are folded into a pack.

In general, when a pack of insert material and a receiving envelope are conveyed to the mail inserter section for mail insertion, they are separately aligned with the center line of the respective feeders. However, misalignment due to various factors may occur such that the required end clearance on one side of the receiving envelope may not be achievable.

It is thus desirable and advantageous to provide a method and system for aligning the pack of insert material relative to the receiving envelope before the insertion is carried out.

SUMMARY IF THE INVENTION

In a mail inserter having an envelope movement mechanism to move an envelope into an insertion station and a feeder to move a pack of insert material into an insertion position so that the insert material can be inserted into the envelope, a first linear array of optical sensing elements is used to determine the position of one edge of the insert material and a second linear array of optical sensing elements operated in a reflective mode is used to determine the position of one edge of the receiving envelope in order to make sure that there is sufficient end clearance between the insert material and the receiving envelope. Preferably, the first linear array is placed on the bottom of the insert material and a light source is placed on top of the insert material to cast a shadow of the insert material on the first linear array so that the edge position of the insert material can be determined from the shadow. As such, the thickness of the insert material can be taken into account when computing the error between the actual end clearance and the desired clearance. A stepper motor is used to move the envelope in a direction substantially perpendicular to the side edges of the envelope for adjusting the end clearance, if the error falls outside of a predetermined range.

DETAILED DESCRIPTION OF THE INVENTION

Figure 1:
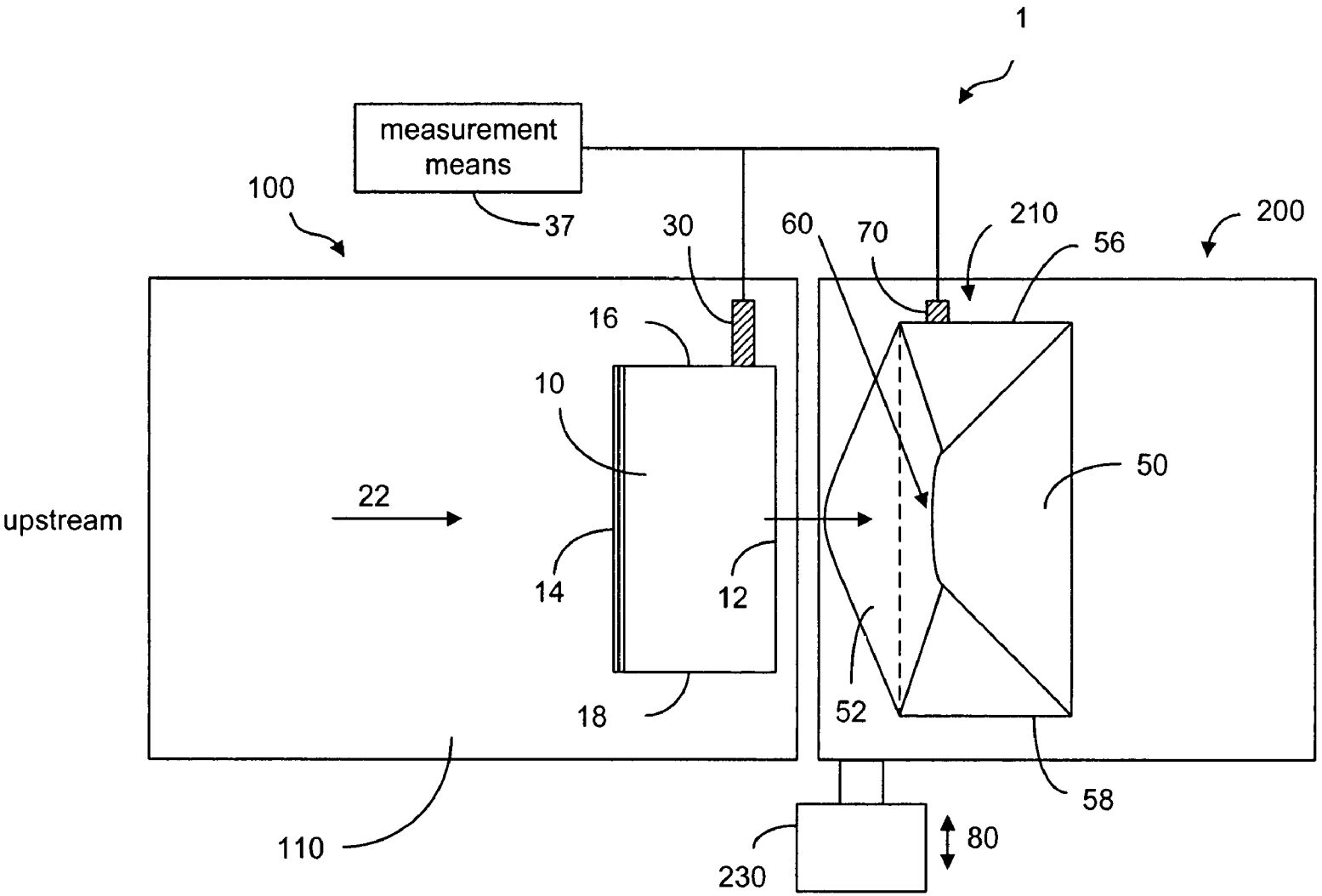
FIG. 1 is a schematic representation of a mail inserter showing an insertion station and an insert feeding station.

FIG. 1 is a schematic representation of a mail inserter section in a mailing machine where a pack of insert material is inserted into an envelope. As shown in FIG. 1, the mail inserter section 1 has a feeder 100 for feeding a pack of insert material 10 from an upstream direction to an insertion station 200. In the insertion station 200, an envelope 50 is placed in an insertion area with the flap 52 of the envelope 50 opened to receive the insert material 10. As shown, the insert 10 has a leading edge 12 and a trailing edge 14 defined by the feeding direction 22. The insert material has a first side edge 16 and a second side edge 18, defining the width of the insert material 10. The envelope 50 has a first side edge 56 and a second side edge 58, defining the width of the envelope. In order to ensure that the insert material 10 is properly inserted into the receiving envelope 50, the width of the envelope must be greater than the width of the insert material by a certain amount so that each side of the envelope will have a sufficient end clearance. Furthermore, the envelope 50 must be placed at a designated location and the insert material 10 must be properly aligned with the width of the envelope 50 before the insert material 10 is inserted into the envelope 10. While it is possible to align the insert material 10 against a reference, such as the center line of the feeder 100, when the insert material 10 is moved to the mail inserter section 100, mechanical tolerances and material tolerances may reduce the end clearance on one side of the envelope In order to ensure that the required end clearance is met before the insert material 10 is inserted into the receiving envelope 50, it is advantageous and desirable to use a sensing mechanism to sense the edge of the incoming insert material 10 and the edge of the receiving envelope 50 already placed at the insertion area. For example, an optical sensor 30 comprised of an array of sensing elements can be placed near the leading edge of the incoming insert material to measure the position of the first edge 16 with respect to a known datum. Likewise, an optical sensor 70 is used to measure the position of the first edge 56 of the receiving envelope 50 with respect to the same datum. The sensors 30 and 70 are operatively connected to a measurement or computation means 37 so that the end clearance available for the first edge 56 of the envelope 50 can be obtained. Based on technology development data, the minimum desired clearance is known and the error between the desired clearance and the measured end clearance can be computed. If the error exceeds a pre-determined amount, the envelope 50 is laterally shifted along direction 80 by a movement mechanism.

Figure 2:
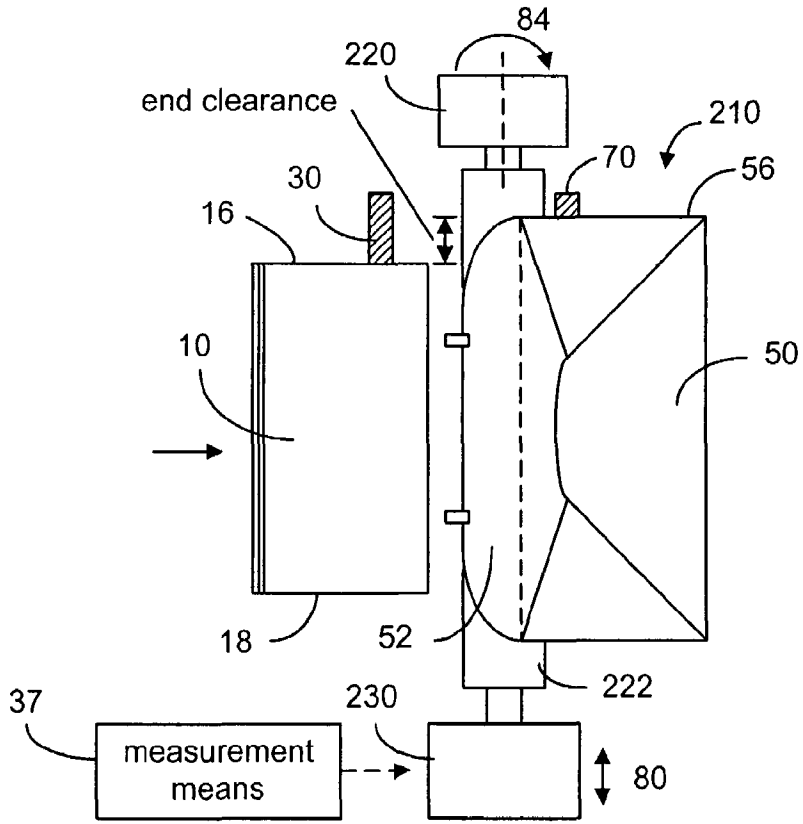
FIG. 2 is a schematic representation of the sensing mechanism and the adjusting mechanism for aligning the receiving envelope.
Figure 3:
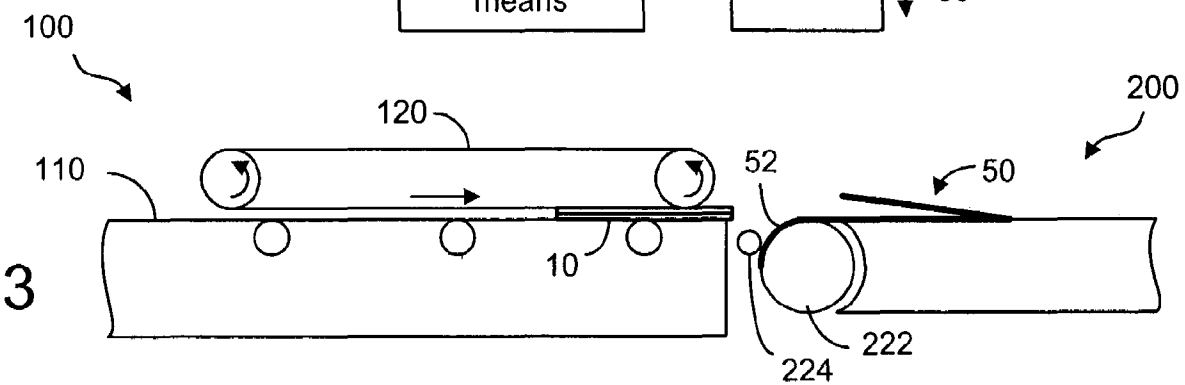
FIG. 3 is a schematic representation of the transport mechanism in a mail inserter.

In one embodiment of the present invention, the receiving envelope 50 is held in a single nip formed by a roller 222 and one or more idlers 224, as shown in FIGS. 2 and 3. The roller 222 is operatively connected to a motor 220 which is adapted to rotate along a rotation direction 84 along the rotational axis of the roller 222 in order to place the envelope 50 at a designated insertion area 210. A linear drive 230 is used to move the envelope 50 laterally by an "error distance" so as to create at least on one side of the envelope 50 the minimum amount of end clearance required to successfully insert the insert material 10. The linear drive 230 comprises a lead screw and a stepper motor, for example, can be used to move the roller 222 along the lateral direction 80.

It is understood that when the required end clearance is achieved at the first edge 56 of the envelope 50, the required end clearance is also available at the second edge 58.

As shown in FIG. 3, the insert material 10 is supported by a supporting deck 110 and moved into the receiving envelope 50 by a conveyor 120, for example. No lateral movement on the insert material is necessary to achieve the required end clearance.

Figure 4:
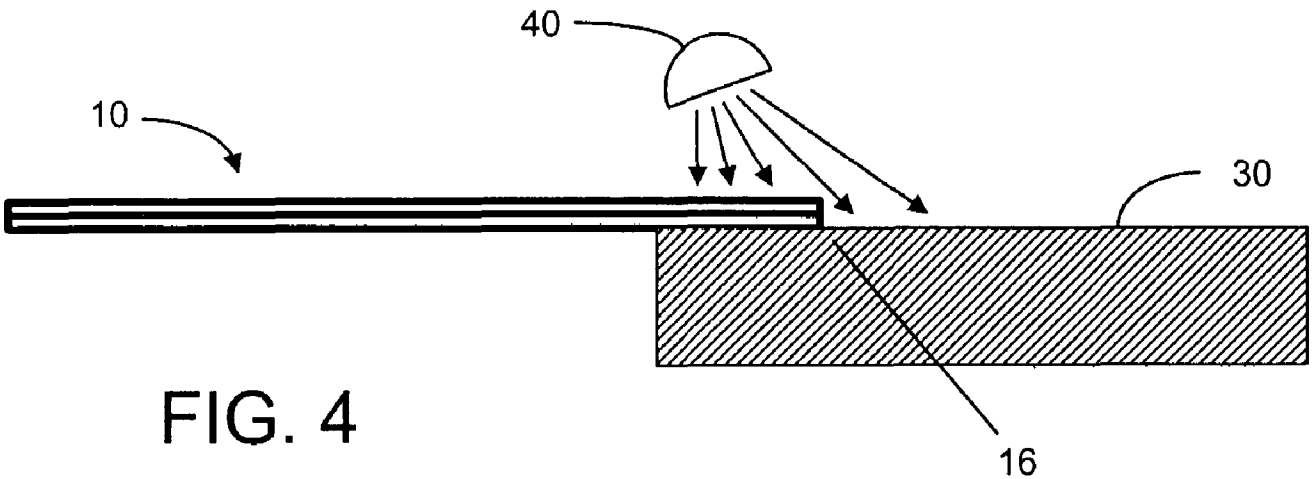
FIG. 4 is a schematic representation of the sensing mechanism for determining the edge position of the insert material.

A light source 40 is used to provide the light beam for optical sensing, as shown in FIG. 4. When the optical sensor 30 is partially covered by an incoming pack of insert material, a shadow is cast on the optical sensor 30. The optical sensor 30 can be a CCD (Charge Coupled Device) linear sensor array, for example. Using such a light source to cast a shadow, a thickness of the pack can be taken into account when computing the error between the actual clearance and the desired clearance. It has been found that the edge position of a pack of insert material up to 6.0 mm thick can be accurately measured with regard to the required end clearance.

Figure 5:
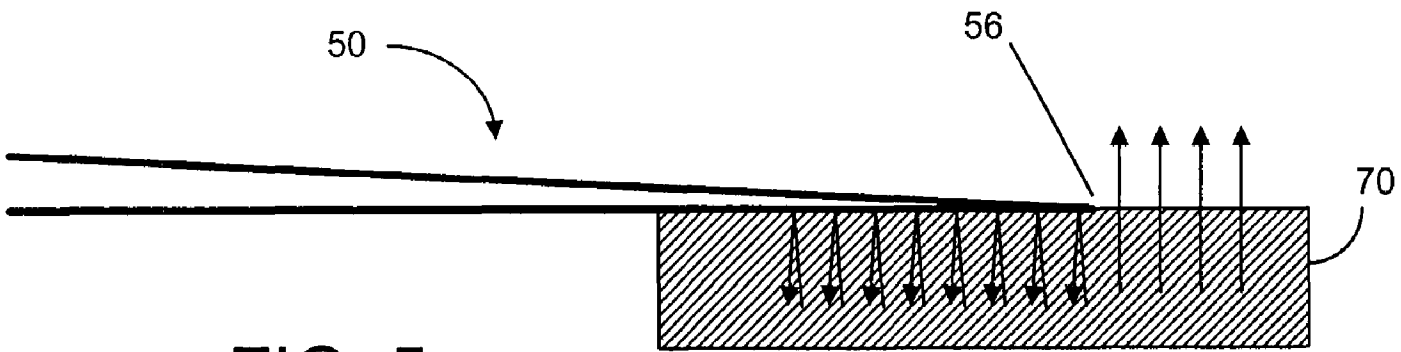
FIG. 5 is a schematic representation of the sensing mechanism for determining the edge position of the receiving envelope.

To measure the edge position of the envelope 50, it is possible to use a CCD linear sensor array in reflective mode. As shown in FIG. 5, the position of the edge 56 of the envelope can be sensed by the reflection of light from the envelope. CCD linear arrays with an approximate linear resolution of 200 DPI (dot-per-inch) can be used for edge measurement, for example. The CCD linear sensor arrays 30, 70 and the stepper motor in the movement mechanism 230 can be read and actuated by a dedicated microprocessor associated with the computing means, for example.

It would be appreciated by persons skilled in the art that there are other ways to achieve the required end clearance. For example, the measurement of the envelope edge can be carried out using an optical sensor in a through beam mode instead of the reflective mode as illustrated.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method of alignment in a mail inserter, the inserter having an insertion station and an insert feeding station adjacent to the insertion station, the insertion station having an insertion position for placing a receiving envelope, the envelope having two side edges defining a width of the receiving envelope, the insert feeding station having a transport mechanism to move insert material into the receiving envelope, the insert material having a leading edge, a trailing edge and two side edges, said method comprising the steps of:

sensing a position of at least one of the side edges of the receiving envelope in the insertion station for providing an envelope edge position;

sensing a position of at least one of the side edges of the insert material in the insert feeding station for providing an insert edge position;

determining an actual edge clearance based upon a distance measurement between the sensed envelope and insert edge positions;

comparing the actual edge clearance to a minimum desired edge clearance to determine an error value therebetween; and adjusting one of the envelope and insert edge positions relative to the other when the error value exceeds a predetermined amount.

2. The method of claim 1, wherein the insert feeding station includes a sensing mechanism disposed adjacent to a side edge of the insert material and wherein the insertion station includes a sensing mechanism disposed adjacent a side edge of the receiving envelope, and further includes the step of sensing the envelope edge and insert positions by comparing each to a known datum.

3. The method of claim 2, wherein the sensing mechanism comprises an array of sensing elements operatively connected to a computation module so as to allow the computation module to determine the position of said side edge based on the known datum in reference to the sensing elements.

4. The method of claim 2, wherein the sensing mechanism comprises a linear array of optical sensors disposed adjacent to one side of the insert material and a light source disposed adjacent to another side of the insert material to cast a shadow of the insert material onto the linear array so as to determine the position of said side edge based on the shadow.

5. The method of claim 2, wherein the insertion and insert feeding stations each have an optical sensing array disposed in relationship to the insert material and receiving envelope, respectively, for determining the position of the respective side edges, and the insertion station has a stepper motor disposed in relationship to the receiving envelope for moving the envelope bi-directionally and substantially perpendicular to side edges of the envelope, and wherein the optical sensing array and the stepper motor are operatively connected to a computation module so as to allow the computation module to adjust one of the envelope and insert edge positions relative to the other based on a reading of the optical sensing array and a position of the stepper motor position.

6. The method of claim 1, wherein insertion station has a movement mechanism disposed in relationship to the receiving envelope, the movement mechanism adapted to move the receiving envelope bi-directionally and substantially perpendicular to the side edges of the receiving envelope for adjusting the relative edge position.

7. The method of claim 6, wherein the movement mechanism comprises a stepper motor.

* * * * *